United States Patent [19]

Mandigo

[11] Patent Number: 4,958,569

[45] Date of Patent: Sep. 25, 1990

[54] WROUGHT COPPER ALLOY-SHAPED CHARGE LINER

[75] Inventor: Frank N. Mandigo, North Branford, Conn.

[73] Assignee: Olin Corporation, New Haven, Conn.

[21] Appl. No.: 499,934

[22] Filed: Mar. 26, 1990

[51] Int. Cl.[5] ..... F42B 10/00

[52] U.S. Cl. ..... 102/476; 102/307; 75/247; 420/472; 420/475

[58] Field of Search ..... 102/476, 307; 75/247; 420/472, 475

[56] References Cited

U.S. PATENT DOCUMENTS

| | | | |
|---|---|---|---|
| 2,870,709 | 1/1959 | Boelter, Jr. | 102/24 |
| 3,025,794 | 3/1962 | Lebourg et al. | 102/24 |
| 3,077,834 | 2/1963 | Caldwell | 102/24 |
| 3,112,700 | 12/1963 | Gehring, Jr. | 102/20 |
| 3,121,389 | 2/1964 | Delacour | 102/20 |
| 3,128,701 | 4/1964 | Rinehart et al. | 102/20 |
| 3,196,792 | 7/1965 | Charrin | 102/24 |
| 3,255,659 | 6/1966 | Venghiattis | 86/20 |
| 3,948,181 | 4/1976 | Bergstrom | 102/56 SC |
| 4,387,773 | 6/1983 | McPhee | 175/4.6 |
| 4,463,678 | 8/1984 | Weiman et al. | 102/307 |
| 4,474,111 | 10/1984 | Kyro et al. | 102/306 |
| 4,498,367 | 2/1985 | Skolnick et al. | 102/306 |
| 4,499,830 | 2/1985 | Majerus et al. | 102/476 |
| 4,766,813 | 8/1988 | Winter et al. | 102/307 |
| 4,862,804 | 9/1989 | Chawia et al. | 102/309 |

OTHER PUBLICATIONS

"Temperature Measurement of Shocked Copper Plates and Shaped Charge Jets by Two-Color ir Radiometry" by Von Holle, Journal of Applied Physics, vol. 47, No. 6, Jun. 1976, pp. 2391-2394.

"Explosives with Lined Cavities" by Birkhoff, Journal of Applied Physics, vol. 19, Jun. 1948, pp. 563-582.

*Primary Examiner*—Stephen J. Lechert, Jr.

*Attorney, Agent, or Firm*—Gregory S. Rosenblatt; Paul Weinstein

[57] ABSTRACT

A wrought metal liner for a shaped charge device having a ductile metal matrix and a discrete second phase is provided. The alloy composition is selected so the second phase is molten when the liner is accelerated following detonation. The molten phase reduces the tensile strength of the matrix so the liner slug is pulverized on striking a well casing. The slug does not penetrate the hole perforated in the well casing by the liner jet and the oil flow into the well bore is not impeded.

18 Claims, 1 Drawing Sheet

WROUGHT COPPER ALLOY-SHAPED CHARGE LINER

This invention relates to a shaped charged device for perforating oil well casings and well bore holes. More particularly, the invention relates to an explosive jet charge capable of perforating an oil well casing without leaving a slug of metal in the resultant hole.

Shaped charges, capable of producing an explosive jet, have been used for many years to perforate oil well bore hole casings. In general, the charges are characterized by a shaped explosive charge housed in a container having one open end. The explosive has a concave surface facing the open end of the container aligned at the point the well casing is to be perforated. The concave surface is lined with a metallic liner to seal off the open end of the charge container. A compressive shock wave generated by detonation of the explosive charge collapses the liner. The inner portion of the liner is extruded into a narrow diameter high speed jet. The jet reaches a speed of about 10,000 m/sec. The remainder of the liner forms a larger diameter slug or "carrot". The slug is slower moving, traveling on the order of about 1000 m/sec and generally follows the path of the jet.

The well casing is perforated at depths where oil bearing earth formations are believed present. Oil flows into the well casing through the perforation holes. The slug has a tendency to embed in the perforated hole impeding the flow of oil into the well casing. The slug may also cause mechanical interlocking between the detonation tube holder which positions the shaped charge and the well casing. Much effort has been exerted to minimize or eliminate the slug.

U.S. Pat. No. 3,077,834 to Caldwell discloses minimizing the slug by forming the liner from loosely packed copper spheres. The spheres may be coated with a low melting metal such as tin to improve adhesion. The slug formed from compacted spheres is porous and fragile When it strikes the wall of the well casing, the slug pulverizes and does not obstruct the flow of oil. Compacted powder liners now comprise about 90% of the oil well market. The liners are usually a mixture of copper and lead spheres containing about 20% by weight lead.

Compacted powder liners are not ideal. As disclosed in U.S. Pat. No. 3,196,792 to Charrin, cold pressed and/or sintered liners are not watertight. The bore hole is frequently filled with fluid. The liner may leak causing the explosive mixture to get wet and fail to detonate. The cold pressed, unsintered powder liners are fragile and prone to break during handling or assembly. The pressed powder surface has a large surface area producing liners which are hydroscopic. The moisture reduces the effectiveness of the explosive mixture. Compacted liners are formed individually increasing the cost. The uniformity of powder composition and compaction pressure may vary from liner to liner and from region to region within a liner. This variation leads to unpredictable jet performance.

The remaining 10% of the oil well market is comprised of wrought metal liners. Wrought metal liners do not have the problems associated with compacted powder liners. However, wrought liners formed from ductile metals and alloys can form relatively large slugs.

One solution has been bi-metallic liners. U.S. Pat. No. 3,025,794 to Lebourg et al discloses a bi-metallic liner comprised of a layer of copper and a layer of zinc. The ductile copper forms the perforating jet. The zinc vaporizes as the slug is accelerated eliminating the slug. Bi-metallic liners have the disadvantage that two layers are bonded together. The quality of the bond influences the jet performance. The extra forming steps add to the cost of the liner.

Wrought metal liners formed from specific alloys have also been disclosed to minimize slug formation. U.S. Pat. No. 3,128,701 to Rinehart et al discloses liners which melt at temperatures of less than 500° C. Among the alloys and metals disclosed are 50%lead/50% tin, 97.6%zinc/1.6%lead and lead, zinc or cadmium metal. The liners melt as the slug travels to the well casing. The molten slug does not obstruct the perforated hole.

U.S. Pat. No. 3,112,700 to Gehring, Jr. discloses binary eutectic alloy liners. The slug is minimized by forming a highly ductile metal matrix with brittle dendrites, uniformly, but discontinuously dispersed throughout the matrix. Among the eutectic o compositions disclosed are 88.8%Pb/11.2%Sb, 61.9%Sn/38.1%Pb and 71.9%Ag/28.1%Cu. While these alloys may reduce slug formation, they are not as easily shaped as more ductile metals such as copper and copper alloys.

Accordingly, the inventor has provided wrought alloy liners which do not have the disadvantages of the prior art. It is an object of the invention to provide a wrought alloy which develops a molten second phase at temperatures ranging from about 350° C. to about 500° C. It is a feature of alloys meeting this objective that the molten second phase decreases the strength of the slug so it pulverizes on impact with the bore casing. A second object of the invention is to provide wrought alloy liners which contain discrete second phase particulate when heated to temperatures lo in the range of about 350° C. to about 500° C. It is a feature of this second objective that the brittle second phase particles serve as crack and nucleation sites so the slug shatters on impact with the bore casing. It is an advantage of the invention that the slugs do not embed in the perforated hole and there is improved flow of oil into the well casing. Another advantage of the invention is that the liner is formed from a wrought metal and is less expensive and more durable than liners formed by powder compaction. A further advantage of the invention is that the wrought liners are waterproof and may be used when the well hole is filled with fluid.

In accordance with the invention, there is provided a wrought metal liner for shaped-charge devices. The liner contains a ductile metal matrix. Dispersed throughout the matrix is a discrete second phase. The second phase has a melting temperature less than the temperature reached by the liner following detonation.

The above-stated objects, features and advantages will become more apparent from the specification and drawings which follow.

IN THE DRAWINGS

Figure 1:
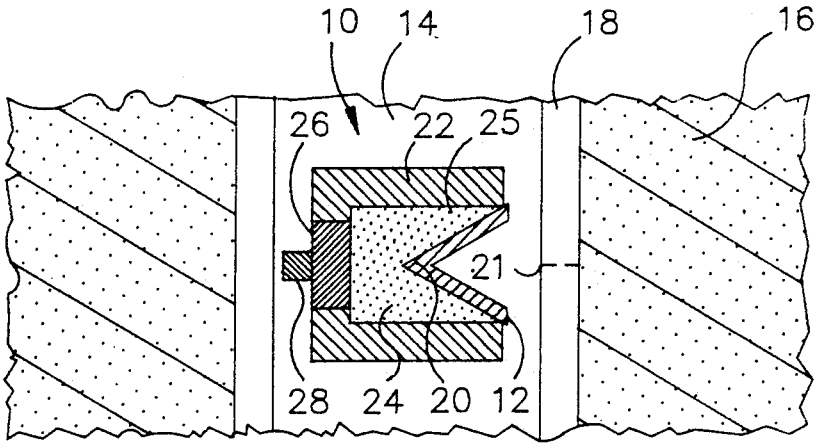
FIG. 1 shows in cross-sectional representation a shaped charge for perforating an oil well casing employing the wrought liner of the invention.

FIG. 1 shows in cross-sectional representation a shaped charge perforating apparatus 10 employing the wrought metal liner 12 of the invention. The shaped charge perforating apparatus 10 is positioned within a well bore 14 which penetrates an oil bearing earth formation 16. A well casing 18 which is usually steel with a thickness of about 0.40 inches maintains the integrity of the well bore. The shaped-charge perforating apparatus 10 is suspended in the well bore 14 such that the apex 20 of the concave shaped wrought liner 12 is aligned with that portion 22 of the well casing 18 to be perforated.

The shaped-charge perforating apparatus 10 comprises a hollow, substantially cylindrical container 22 which may be made from any suitable metal, plastic or rubber. The internal cavity 24 of the casing 22 has a shape determined by the liner 12. The cavity 25 is filled with a suitable explosive such as 75/25 Octol. A booster 26 initiates the explosion when detonator 28 is activated by an operator located on the surface.

When the explosive 25 is detonated, a compressive shock wave is generated. The shock wave compresses the liner 12. The apex 20 of the liner 12 is extruded outwardly at high velocity forming a penetrating jet. The penetrating jet perforates the portion 22 of the well casing 18 to facilitate the entry of oil from the oil-bearing, earth formation 16. The remainder of the liner 12 forms the slow moving slug which trails the jet and is preferably pulverized. Formation of the slug and jet may be more clearly seen with reference to FIG. 2.

Figure 2:
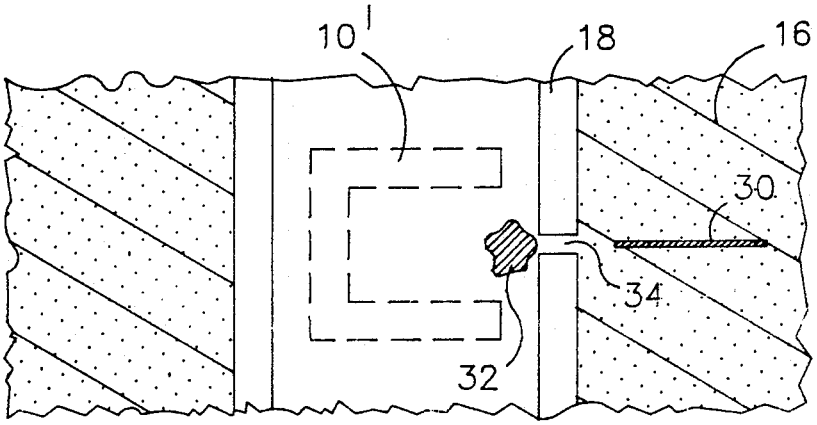
PRIOR ART FIG. 2
FIG. 2 shows in cross-sectional representation the jet and slug which develop from a prior art wrought liner.

FIG. 2 shows in cross-sectional representation, a detonated shaped charge perforating apparatus 10'. The liner, a conventional ductile metal such as copper, is explosively compressed into a rapidly moving jet 30 and a relatively slow moving slug 32. The jet 30 perforates the well casing 18 forming a perforation hole 34. The trailing slug 32 frequently embeds in the perforation hole 34 inhibiting the flow of oil from the oil-bearing, earth formation 16.

In accordance with a first embodiment of the invention, the liner is formed from specific metal alloys. The slug is sufficiently weakened that when it strikes the well casing 18 it pulverizes and does not obstruct the perforation hole 34. The wrought metal liners of the invention are formed from an alloy which when heated to the temperature reached by the liner after detonation form a ductile matrix and a molten second phase dispersed throughout the matrix.

As disclosed in an article by Von Holle entitled "Temperature Measurement of Shocked Copper plates and Shaped-Charge Jets by Two-Color IR Radiometry", the detonation process develops a temperature in the range of about 350° C. to about 500° C. in the slug residual. Micrographic examination of wrought liners formed from copper alloy C110(electrolytic tough pitch copper having the nominal composition 99.90% minimum copper), C260 (cartridge brass having the nominal composition by weight of 70% copper and 30% zinc) and C544 (leaded bearing rods, having the composition 89% copper, 4% lead, 4% tin and 3% zinc) by the Applicant confirms this estimate. An alloy which has a molten phase at this temperature will have the unique characteristic of producing no slug residual.

The desired alloys are multiple phase and comprise a ductile matrix and a discrete second phase. The second phase has a melting temperature less than the temperature reached by the liner after detonation. For ease of formability and maximum jet penetration the matrix is selected to be highly ductile. Preferably, the metal matrix is copper or a copper alloy. The discrete second phase is any element or alloy with a sufficiently low melting point. The concentration of the SeCOnd phase is low enough that does bulk alloy does not lose its wrought property to the extent that the alloy becomes non-workable.

For a copper base alloy, lead and lithium are preferred alloying elements. Additional elements which do not significantly deteriorate the mechanical properties of the matrix and do not significantly raise the melting temperature of the second phase may also be present.

Among the preferred binary alloys are copper/1–5 wt. % lithium and copper/lead. The lead is present in an effective concentration to reduce the tensile strength of the slug. The maximum lead concentration is that which can be dispersed in the copper matrix during casting. Using conventional casting techniques with stirring, up to about 20 wt. % lead may be added. More preferably, the lead is present in a concentration of about 5 to about 15% by weight. As stated above, other elements may be present in either the matrix or second phase.

Suitable ternary alloys include copper/3–12 wt. % tin/0.5–5.0 wt. % phosphorus and preferably copper/5 wt. % tin/2 wt. % phosphorus. A suitable quaternary alloy is copper/5 wt. % tin/5 wt. % lead/5 wt % zinc. Other preferred alloys include copper alloy C544 and copper alloy C544 with 0.5–5.0 weight percent phosphorus added.

Improvement achieved by the alloys of the invention will be more clearly seen by the example which follows.

EXAMPLE

Wrought copper alloy shaped charge liners were formed from copper alloys C110, C260 and C544 by rolling the desired alloy into a sheet having a thickness of 0.027 inches. The sheet was formed into a liner having a generally conical shape with a diameter of 1.6 inches and a height of 1.7 inches. The liners were inserted into a shaped charge perforating apparatus as illustrated in FIG. 1 which was detonated. The apparatus was positioned so that the jet and slug would embed in concrete and be recovered. The slugs were weighed. The C544 slug had significantly reduced weight as compared to the other alloys. The reduced weight indicates the tensile strength of the C544 slug was reduced and the slug crumbled on impact.

| Alloy | Slug Residual, Grams |
|---|---|
| C110 | 7.5 |
| C260 | 6.8 |
| C544 | <1.5 |

Figure 3:
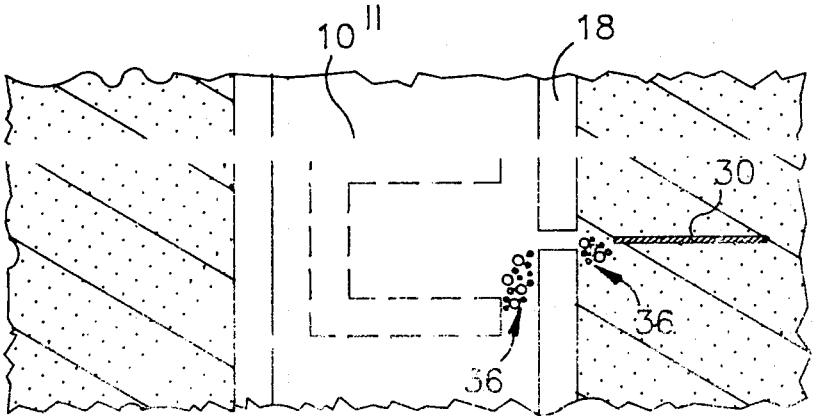
FIG. 3 shows in cross-sectional representation, the jet and pulverized slug resulting from the wrought liner of the invention.

With reference to FIG. 3, following detonation of the shaped charge perforating apparatus 10'' having a liner manufactured from an alloy in accordance with the invention, the penetrating jet 30 penetrates the well casing 18 forming a perforation hole 34. The slug heats up to a temperature above the melting point of the discrete second phase of the alloy. Molten pockets develop within the alloy, drastically reducing its strength. When the slug strikes the well casing 18, it pulverizes into small metallic particles 36 which either pass through the perforation hole 34 or drop within the well bore 14. The slug is destroyed. The perforation hole is not blocked and oil flow is not impeded.

In a second embodiment of the invention, the second phase does not melt, but forms crack nucleation sites that cause the slug to break up following detonation. For this embodiment, any alloy which forms a ductile metal matrix and a discrete, brittle second phase at the temperature achieved by the slug is satisfactory. Preferably, the metal matrix is copper or a copper alloy and the second phase is present at temperatures in the range of from about 350° C. to about 500° C. The second phase forms crack nucleation sites which decrease the ductility of the slug. The slug pulverizes upon impact with the well casing 18. Alloys in accordance with this embodiment of the invention may be formed from copper and include element selected from the group consisting of magnesium, phosphorus, tin, zirconium, antimony and mixtures thereof. Other elements which may comprise a o component of the matrix or of the precipitated second phase may also be present. Preferred alloy is copper/3–6 weight percent magnesium and copper/-3–6 weight percent phosphorus.

While the invention has been described in terms of shaped charge perforating apparatus for oil well applications, it is equally applicable to other shaped charge applications such as armor piercing charges.

The patents and publication cited herein are intended to be incorporated by reference.

It is apparent that there has been provided in accordance with this invention, a shaped charge liner which fully satisfies the objects, features and advantages set forth herein before. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A wrought metal liner for a shaped charge device, said liner being shaped so as to comprise upon detonation of said device and formed from a multiple phase alloy having:

a ductile metal matrix and a discrete second phase dispersed in said matrix wherein said second phase has a melting temperature less than the temperature reached by said liner following detonation.

2. The wrought metal liner of claim 1 wherein said ductile metal matrix consists essentially of copper or a copper alloy.

3. The wrought metal liner of claim 2 wherein said second phase is molten when heated to a temperature in the range of from about 350° C. to about 500° C.

4. The wrought metal line of claim 3 wherein said second phase includes at least one element selected from the group consisting of lead and lithium.

5. The wrought metal liner of claim 4 wherein said alloy contains an effective concentration up to about 20 weight percent lead.

6. The wrought metal liner of claim 5 wherein said alloy contains from about 5 to about 15 weight percent lead.

7. The wrought metal liner of claim 3 wherein said alloy contains from about 3 to about 12 weight percent tin, from about 0.5 to about 5.0 weight percent phosphorus and the balance copper.

8. The wrought metal liner of claim 4 wherein said alloy contains from about 1 to about 5 weight percent lithium.

9. The wrought metal liner of claim 5 wherein said alloy is copper alloy C544.

10. The wrought metal liner of claim 9 wherein said alloy is copper alloy C544 to which from about 0.5 to about 5.0 weight percent phosphorus has been added.

11. The wrought metal liner of claim 7 wherein said alloy consists essentially of from about 5 weight percent tin, about 2 weight percent phosphorus and the balance copper.

12. The wrought metal liner of claim 5 wherein said alloy consists essentially of about 5 weight percent tin, about 5 weight percent lead, about 5 weight percent zinc and the balance copper.

13. A wrought metal liner for a shaped charge device, said liner being shaped so as to comprise upon detonation of said device and formed from a multiple phase alloy having:

a ductile metal matrix and a discrete, brittle second phase dispersed in said matrix wherein said second phase is present as a precipitate in said matrix at the temperature reached by said liner following detonation.

14. The wrought metal liner of claim 13 wherein said ductile metal matrix consists essentially of copper or a copper alloy.

15. The wrought metal liner of claim 14 wherein said second phase is selected to have a composition which will be present as a precipitate from said copper or copper alloy matrix at a temperature of from about 350° C. to about 500° C.

16. The wrought metal liner of claim 15 wherein said second phase includes at least one element selected from the group consisting of magnesium, phosphorus, tin, zirconium and antimony.

17. The wrought metal liner of claim 16 wherein said alloy contains from about 3 to about 6 weight percent magnesium.

18. The wrought metal liner of claim 16 wherein said alloy contains from about 0.5 to about 5.0 weight percent phosphorus.

* * * * *

UNITED STATES PATENT AND TRADEMARK OFFICE

CERTIFICATE OF CORRECTION

PATENT NO. : 4,958,569

DATED : September 25, 1990

INVENTOR(S) : MANDIGO

It is certified that error appears in the above—identified patent and that said Letters Patent is hereby corrected as shown below:

Column 5, line 43, please delete "comprise" and insert ---compress---.

Column 6, line 31, please delete "comprise" and insert ---compress---.

Signed and Sealed this

Third Day of March, 1992

*Attest:*

HARRY F. MANBECK, JR.

*Attesting Officer*

*Commissioner of Patents and Trademarks*

US004958569B1

REEXAMINATION CERTIFICATE (3369th)

United States Patent [19] [11] B1 4,958,569

Mandigo [45] Certificate Issued Nov. 4, 1997

[54] WROUGHT COPPER ALLOY-SHAPED CHARGE LINER

[75] Inventor: Frank N. Mandigo, North Branford, Conn.

[73] Assignee: Olin Corporation, Cheshire, Conn.

Reexamination Request:
No. 90/004,316, Jul. 29, 1996

Reexamination Certificate for:

| | |
|---|---|
| Patent No.: | **4,958,569** |
| Issued: | **Sep. 25, 1990** |
| Appl. No.: | **499,934** |
| Filed: | **Mar. 26, 1990** |

[51] Int. Cl.[6] ..... F42B 10/00

[52] U.S. Cl. ..... 102/476; 102/307; 75/247; 420/472; 420/475

[58] Field of Search ..... 102/307, 306, 102/309, 476; 148/432, 435, 436

[56] References Cited

U.S. PATENT DOCUMENTS

| | | | |
|---|---|---|---|
| 2,870,709 | 1/1959 | Boetter, Jr. | 102/24 |
| 3,025,794 | 3/1962 | LeBourg et al. | 102/306 |
| 3,077,834 | 2/1963 | Caldwell | 102/24 |
| 3,112,700 | 12/1963 | Gehring, Jr. | 102/20 |
| 3,121,389 | 2/1964 | Delacour | 102/20 |
| 3,128,701 | 4/1964 | Rinehart et al. | 102/20 |
| 3,136,249 | 6/1964 | Poulter | 102/24 |
| 3,196,792 | 7/1965 | Charrin | 102/24 |
| 3,255,659 | 6/1966 | Venghiattis | 86/20 |
| 3,375,107 | 3/1968 | Kranz | 75/156.5 |
| 3,894,867 | 7/1975 | Fishman et al. | 75/134 N |
| 3,948,181 | 4/1976 | Bergstrom | 102/56 SC |
| 4,220,687 | 9/1980 | Christopher | 428/546 |
| 4,387,773 | 6/1983 | McPhee | 175/4.6 |
| 4,463,678 | 8/1984 | Weimer et al. | 102/307 |
| 4,474,113 | 10/1984 | Kyröet al. | 102/306 |
| 4,494,461 | 1/1985 | Pryor et al. | 102/464 |
| 4,498,367 | 2/1985 | Skolnick et al. | 86/1 R |
| 4,499,830 | 2/1985 | Majerus et al. | 102/476 |
| 4,638,535 | 1/1987 | Pryor et al. | 65/18.1 |
| 4,766,813 | 8/1988 | Winter et al. | 102/307 |
| 4,794,990 | 1/1989 | Riggs | 166/902 |
| 4,840,654 | 6/1989 | Pryor | 29/1.3 |
| 4,862,804 | 9/1989 | Chawla et al. | 102/309 |
| 5,098,487 | 3/1992 | Brauer et al. | 148/432 |
| 5,221,808 | 6/1993 | Werner et al. | 102/307 |
| 5,413,048 | 5/1995 | Werner et al. | 102/307 |

OTHER PUBLICATIONS

*C.D.A. Publication* (No. 36, 5th ed.) Classification of Copper and Copper Alloys at 1–27. 1941.

*Metals Handbook*, Properties and Selection: Nonferrous Alloys and Pure Metals (9th ed. vol. 2). Selection and Application of Copper Alloy Casings at 383–439. 1979.

Hudson, *Gunmetal Castings—Their Production, Properties and Application* Effect of Composition on Properties of Castings; at 51–153, Macdonald and Co., publishers. 1967.

Fascetta et al. *Cast Metals Research Journal* vol. 9, No. 4. Die Casting Partially Solidified High Copper Content Alloys at 167–171. Dec. 1973.

Cambell *Foundry Trade Journal, Rheocasting and Thixocasting—A Review of Progress To–Date*, at 293–295, Feb. 1975.

Arthur D. Little, Inc. *Collection and Arrangement of Shaped Charge Data. Armed Services Technical Information Agency; Interim Report*; Contract No. DAI–19–020–501–ORD(P)50; Ordnance Project TA3–5204; C–59292. Oct. 1955.

Brimmer, Robert A. *Manual for Shaped–Charge Design.* Navorod Report 1248. No. AD B954297. Aug. 1950.

(List continued on next page.)

*Primary Examiner*—Peter A. Nelson

[57] ABSTRACT

A wrought metal liner for a shaped charge device having a ductile metal matrix and a discrete second phase is provided. The alloy composition is selected so the second phase is molten when the liner is accelerated following detonation. The molten phase reduces the tensile strength of the matrix so the liner slug is pulverized on striking a well casing. The slug does not penetrate the hole perforated in the well casing by the liner jet and the oil flow into the well bore is not impeded.

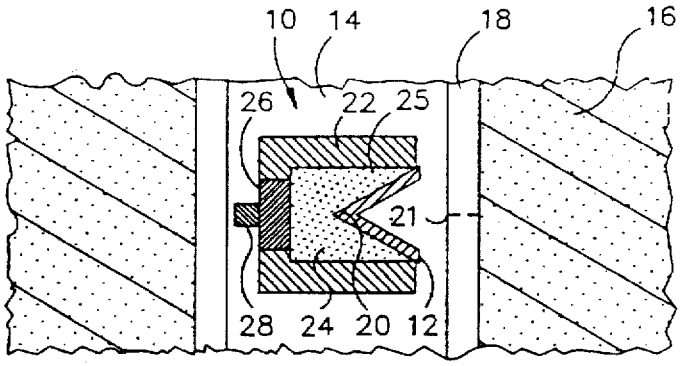

OTHER PUBLICATIONS

Zernow et al. *BRL Report No. 965 An Experimental Study of the Brass System (Cu–Zn) In Shaped Charges.* Oct. 1955.
"*Reference D*" at 299 and 304, undated.
Shewmon *Transformation in Metals* at 252–261, 1983.
Massalski *Binary Alloy Phase Diagrams* vol. 1.
West, *Copper Alloy Systems* Chapter 4; at 84–111, published by Halstead Press. 1982.
Duffy and Golaski *Technical Report BRL–TR–2800 Effect of Liner Grain Size on Shaped Charge Jet Performance and Characteristics.* Apr. 1987.
Lipson et al. *Fabrication and Evaluation of Various Shaped Charge Liner Materials. Part I. Casting of Experimental Cones for Evaluation of Cone Performance.* undated.
W. G. Von Holle and J.J. Trimble *Journal of Applied Physics* vol.47. No. 6. Temperature Measurement of Shocked Copper Plates and Shaped Charge Jets by Two–Color IR Radiometry, At 2391–2394. 1976.
Birkhoff et al. *Journal of Applied Physics* vol. 19 Explosives with Lined Cavites. At 563–582. Jun. 1948.
*ASM Metals Handbook* Properties of Wrought Copper. vol. 2, pp. 356–357. 1979.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–12 and 14–18 is confirmed.

Claim 13 is determined to be patentable as amended.

New claims 19 and 20 are added and determined to be patentable.

13. A wrought metal liner for a shaped charge device, said liner being shaped so as to compress upon detonation of said device and formed from a multiple phase alloy having:

a ductile metal matrix and a discrete, brittle second phase dispersed in said matrix wherein said second phase is present as a precipitate in said matrix *that is effective to form crack nucleation sites that cause the slug to break up following detonation* at the temperature reached by said liner following detonation.

*19. A wrought metal liner for a shaped charge device, said liner being shaped so as to compress upon detonation of said device and formed from a multiple phase alloy having:*

*a ductile metal matrix consisting essentially of copper or a copper alloy; and*

*a discrete second phase dispersed in said matrix, said discrete second phase including lead, with said lead present in the alloy in an amount of from that effective to cause a slug formed during explosive compression of said liner to pulverize on impact with an oil well casing up to about 20 weight percent.*

*20. The wrought metal liner of claim 19 wherein said liner is formed from copper alloy C544.*

* * * * *